US009458559B2

(12) United States Patent
Usuki

(10) Patent No.: US 9,458,559 B2
(45) Date of Patent: Oct. 4, 2016

(54) MULTI-LAYER FABRIC

(75) Inventor: Tsutomu Usuki, Shizuoka (JP)

(73) Assignee: NIPPON FILCON CO., LTD., Inagi-shi, Tokyo (JP)

( * ) Notice: Subject to any disclaimer, the term of this patent is extended or adjusted under 35 U.S.C. 154(b) by 0 days.

(21) Appl. No.: 13/824,511

(22) PCT Filed: Mar. 21, 2012

(86) PCT No.: PCT/JP2012/057093

§ 371 (c)(1),
(2), (4) Date: Jul. 9, 2013

(87) PCT Pub. No.: WO2012/140992

PCT Pub. Date: Oct. 18, 2012

(65) Prior Publication Data

US 2014/0020786 A1 Jan. 23, 2014

(30) Foreign Application Priority Data

Apr. 11, 2011 (JP) ..... 2011-087481

(51) Int. Cl.

| | |
|---|---|
| ***D03D 3/04*** | (2006.01) |
| ***D21F 1/10*** | (2006.01) |
| ***D03D 11/00*** | (2006.01) |
| ***D04H 13/00*** | (2006.01) |
| ***D21F 1/00*** | (2006.01) |
| ***D03D 1/00*** | (2006.01) |
| ***D04H 1/70*** | (2012.01) |

(52) U.S. Cl.

CPC ..... *D04H 13/00* (2013.01); *D03D 1/0094* (2013.01); *D03D 11/00* (2013.01); *D04H 1/70* (2013.01); *D21F 1/0036* (2013.01)

(58) Field of Classification Search

CPC ..... D21F 1/0036; D21F 1/0045; D21F 1/10; D03D 11/00; D03D 3/04

See application file for complete search history.

(56) References Cited

U.S. PATENT DOCUMENTS

| | | | | |
|---|---|---|---|---|
| 4,351,874 | A * | 9/1982 | Kirby | 442/195 |
| 4,420,529 | A * | 12/1983 | Westhead | 442/187 |
| 5,437,315 | A | 8/1995 | Ward | |
| 7,005,038 | B2 * | 2/2006 | Maguire | 162/348 |
| 7,216,677 | B2 * | 5/2007 | Fujisawa | 139/383 A |
| 7,270,151 | B2 * | 9/2007 | Nagura et al. | 139/383 A |
| 7,306,014 | B2 * | 12/2007 | Nagura et al. | 139/383 A |

(Continued)

FOREIGN PATENT DOCUMENTS

| | | |
|---|---|---|
| EP | 1 586 696 | 10/2005 |
| JP | 2558154 | 9/1996 |

(Continued)

OTHER PUBLICATIONS

International Search Report for PCT/JP2012/057093 (3 pgs.).

*Primary Examiner* — Bobby Muromoto, Jr.

(74) *Attorney, Agent, or Firm* — Flynn, Thiel, Boutell & Tanis, P.C.

(57) ABSTRACT

A multi-layer nonwoven fabric at least constituted by a first warp, a second warp, an upper surface side weft, and a lower surface side weft, the first warp is woven with the wefts of all layers from the upper surface side weft to the lower surface side weft, the second warp is only woven with the upper surface side weft, the first warp constitutes a pair to form one upper surface side warp structure on an upper surface side layer, whereby a complete structure of a plain weave design is formed by the first and second warps.

7 Claims, 8 Drawing Sheets

(56) References Cited

U.S. PATENT DOCUMENTS

| | | | | |
|---|---|---|---|---|
| 7,343,938 | B2 * | 3/2008 | Takimoto | 139/383 A |
| 7,464,731 | B2 * | 12/2008 | Fujisawa | 139/383 A |
| 7,861,747 | B2 | 1/2011 | Quigley | |
| 2005/0067039 | A1 * | 3/2005 | LaFond et al. | 139/383 A |
| 2006/0116042 | A1 * | 6/2006 | Nagura et al. | 442/205 |
| 2007/0095417 | A1 * | 5/2007 | Fujisawa | 139/383 A |
| 2009/0205740 | A1 * | 8/2009 | Quigley | 139/408 |

FOREIGN PATENT DOCUMENTS

| | | |
|---|---|---|
| JP | 2006-057215 | 3/2006 |
| JP | 2007-092268 | 4/2007 |
| JP | 2010-529322 | 8/2010 |

* cited by examiner

MULTI-LAYER FABRIC

TECHNICAL FIELD OF THE INVENTION

The present invention relates to a multi-layer fabric which exhibits good air permeability and good lateral rigidity, in particular, relates to a multi-layer fabric which solves a fiber sticking problem which has occurred in conventional fabrics, and improves the surface density, the oblique rigidity, and the sheet supportability.

BACKGROUND ART

Conventionally, unwoven fabrics have been formed by transporting fiber material after the fiber material is supplied on an endless running mesh belt. Many kinds of methods of forming the unwoven fabric have been known, and new technology for forming the unwoven fabric has been also developed.

It is difficult to clearly classify the methods of forming the unwoven fabric. When they are classified mainly in accordance with the process for binding the fibers, one is a thermal bonding method in which compound fibers of the core and sheath type with which a resin with a low melting point is covered are adopted, or the fiber material with which a resin with a low melting point powder is mixed is supplied on the mesh belt, so that the low melting resin is melted by the heating or an ultra-sound welder to cause fusion between the fibers, whereby the nonwoven fabric is formed. In addition, one is a resin bonding method in which the fiber material is supplied on the mesh belt where an adhesive resin is impregnated and then dried to form the nonwoven fabric. Further, there are the chemical bonding method and the span racing method in which the fibers are intersected by high-pressure water flow.

When the method of forming nonwoven fabric is classified in accordance with the process of supplying the fiber material, the carding method in which the fiber material is supplied using the carding machine, the air raid method in which the fiber material which has been unwoven is supplied using air, or the span bonding method in which yarn which is spun from fiber material in a form of yarn is directly supplied on the mesh belt without using the fibers which has been formed into the nonwoven fabric, and the adjacent fibers are fused by the heating, etc. In addition, the melt blow method in which the fibers are spun in the form of mist to be supplied on the mesh belt is known.

As stated above, there are various kinds of methods of forming the nonwoven fabric. In particular, in the span bonding method, good lateral rigidity, good air permeability, and good sheet supportability are required for the nonwoven fabric. More specifically, since the nonwoven fabric is caused to shift laterally during its running, it is necessary to apply a palm to the nonwoven fabric to rectify its shift. That is why the nonwoven fabric can fold due to its contact with the palm, if the lateral rigidity of the nonwoven fabric is low.

In addition, it is necessary to set the air permeability required for the nonwoven fabric appropriately in accordance with the nonwoven fabric to be formed. More specifically, if the air permeability is too high, the fibers can be removed, while, on the other hand, if it is too low, an effect of vacuuming can be reduced. Furthermore, when the nonwoven fabric is transported, the nonwoven fabric can be folded due to the fact that the formed nonwoven fabric can shift on the fibers if the sheet supportability of the nonwoven fabric is too low.

More specifically, a conventional fabric is shown by FIG. 19 in Patent document 1 (Japanese Patent No. 2558154). In such a conventional fabric, the fibers can be stuck into the fabric as the time elapses due to its repeated use in the forming process of the nonwoven fabric, although it has initially very good air permeability. Here, the fibers sticking phenomenon is defined to be the one in which the fibers can enter into a space between intersections of knuckles of wires. If such a phenomenon occurs, the wires can dig into the nonwoven fabric, or the air permeability of the fabric can be reduced.

FIG. 15 is a picture which shows a situation in which the fibers of the conventional fabric are stuck. As readily seen from FIG. 15, the fibers enter into a space where yarns are woven. This fiber sticking situation can be generated because the force by which the intersection of the wires is supported is low. In other words, if such a supporting force is low, the wire can rattle during its transportation, so that the fibers can be sandwiched between the space between intersections of knuckles of wires.

Here, the force by which the intersection of the wires is supported is defined to be the one which is applied to both of a weft and a warp at a knuckle portion. Generally, the supporting force is high when the knuckle is constituted by a single yarn, whereas, the supporting force tends to be low when the knuckle is constituted by multiple yarns.

That is why the weave design in which the supporting force is the highest is a plain weave design. Because, in the plain weave design, each of all the knuckles is constituted by a single yarn, so that the density of the knuckles becomes the highest.

However, in a conventional fabric, such a plain weave design cannot be adopted because the surface density can be reduced if the diameter of the weft is increased, which causes an incompatibility between the lateral rigidity and the surface density. That is why the plain weave design has not been adopted in the conventional fabric.

Patent Publication 1: Japanese Patent No. 2558154

DISCLOSURE OF THE INVENTION

Technical Problems to be Solved by Present Invention

The object of the present invention is to provide a multi-layer fabric which is capable of meeting required characteristics for A fabric such as good air permeability and high lateral rigidity while, at the same time, solving a fiber sticking problem caused by the use of the fabric which has arisen in the conventional fabric and of improving the surface density and the oblique rigidity to increase the sheet supportability.

The object of the present invention is to provide a multi-layer fabric which includes a structure in which a lower surface side of wefts protrudes from an underside to be worn.

Means to Solve Technical Problems

The multi-layer fabric of the present invention can exhibit good air permeability, high lateral rigidity, while at the same time solve a technical problem of the fiber sticking problem and improve the surface density and the oblique rigidity to increase the sheet supportability.

More specifically, the present invention adopted the following structure in order to solve the above technical problems.

(1) In a multi-layer fabric at least constituted by a first warp, a second warp, an upper surface side weft, and a lower surface side weft, the first warp is woven with the wefts of all layers from the upper surface side weft to the lower surface side weft, the second warp is only woven with the upper surface side weft, the first warp constitutes a pair to form one upper surface side warp structure on an upper surface side layer, whereby a complete structure of a plain weave design is formed by the first and second warps.

(2) The multi-layer fabric according to (1), wherein said first warp and said second warp are arranged to form a pair, respectively, on the upper surface side layer.

(3) The multi-layer fabric according to (1) or (2), wherein said upper surface side weft and said lower surface side weft constitute an off-stack structure, respectively.

(4) The multi-layer fabric according to any of (1) to (3), wherein a portion or all of said first warp is at least formed by a carbon line.

(5) The multi-layer fabric according to any of (1) to (4), wherein said pair of said first warps and said pair of said second warps are arranged in an alternate manner.

(6) The multi-layer fabric according to any of (1) to (5), wherein said multi-layer fabric constitutes a two-layer fabric.

(7) The multi-layer fabric according to any of (1) to (5), wherein said multi-layer fabric further includes an intermediate weft to constitute a three-layer fabric.

EFFECT OF THE INVENTION

Figure 1:
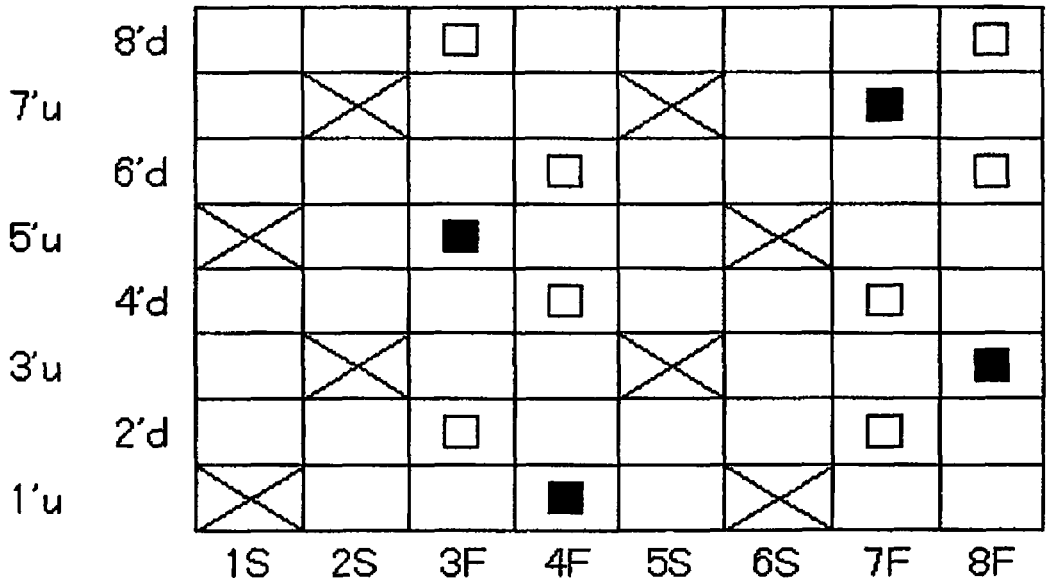
FIG. 1 is a design view showing a complete structure of the first embodiment according to the present invention.

According to the multi-layer fabric of the present invention, good air permeability and high lateral rigidity, which are required for a nonwoven fabric, are secured, while the fiber sticking problem due to the used of the fabric which has been caused in the conventional nonwoven fabric can be solved, and the surface density and the oblique rigidity can be improved, so that the sheet supportability can be enhanced.

In addition, a structure of a weft worn type is formed by adopting a long crimp as the lower surface side weft, so that a multi-layer fabric with excellent wear resistance can be provided.

DETAILED DESCRIPTION OF THE INVENTION

Now, the structure and the effect of the multi-layer fabric of the present invention will be described below. Embodiments of the multi-layer fabric of the present invention will be described thereafter with reference to the drawings.

The multi-layer fabric of the present invention is one which includes at least first and second warps and upper and lower surface side wefts. An intermediate weft may be added to the wefts.

The first warp has a technical feature in which it is woven with the wefts of all layers from the upper lower surface side weft to the lower surface weft. In addition, the second warp has a technical feature in which it is only woven with the wefts of the upper lower surface side weft.

In the multi-layer fabric of the present invention, on the upper surface side, at least first warps forma pair of two yarns. The first warps define an upper surface side warps structure by forming such a pair. Alternatively, the first and second warps may be arranged so as to form a pair.

Furthermore, the upper surface side warp structure is formed by the first and second warps and the upper surface side structure constitutes a plain weave design.

In addition, the upper surface side wefts and the lower surface side wefts may constitute an off-stack structure, respectively. Here, the off-stack structure is defined to be the structure in which vertically adjacent yarns extending in the same direction are disposed so as not to vertically overlap. For instance, the upper surface side wefts and the lower surface side wefts are disposed so as not to overlap in the vertical direction of the fabric surface.

As to a three-layer fabric, the upper surface side wefts, the intermediate wefts, and the lower surface side wefts are disposed so as not to overlap in the vertical direction. In this case, the intermediate wefts and the lower surface side wefts may be disposed to overlap in the vertical direction. By adopting such an off-stack structure, a special density can be increased by enhancing the closeness of the upper and lower surface side wefts and, as a result, the fibers can be effectively prevented from being removed.

In the present invention, a complete structure is defined to be a minimum unit by a plurality of which constitutes the fabric structure. More specifically, such a unit is repeated in the longitudinal direction of the fabric structure and in the direction perpendicular to the longitudinal direction to form the fabric structure. A knuckle is a portion of a warp which passes over or below one or more of wefts to protrude from the surface, a crimp is a long floating portion of a weft formed on the surface which passes above or below one or more of warps.

In the present invention, a weft with a large diameter can be used irrespective of the plain weave design on the surface. In the conventional multi-layer fabric, the surface density is decreased if the weft with a large diameter is used as the plain weave design. However, in the present invention, the surface density can be increased by constituting the warps by the first and second warps, while at the same using the weft with a large diameter as the lower surface side weft and the weft with a large diameter as the upper surface side weft, the diameter of which is smaller than that of the lower surface side weft.

Figure 10:
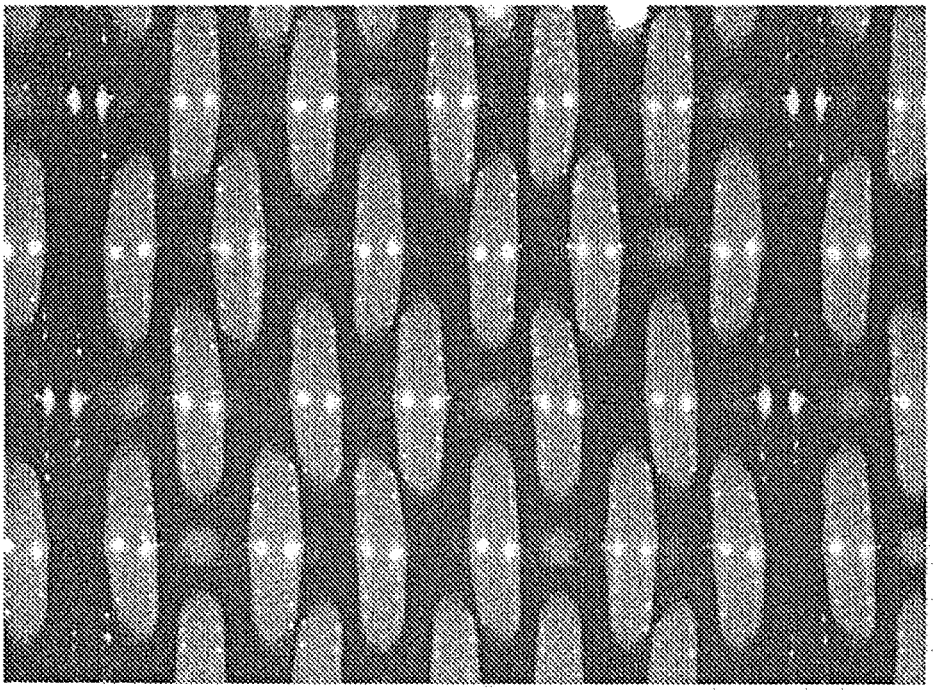
FIG. 10 is a picture showing the upper surface side of the fabric of the first embodiment.
Figure 11:
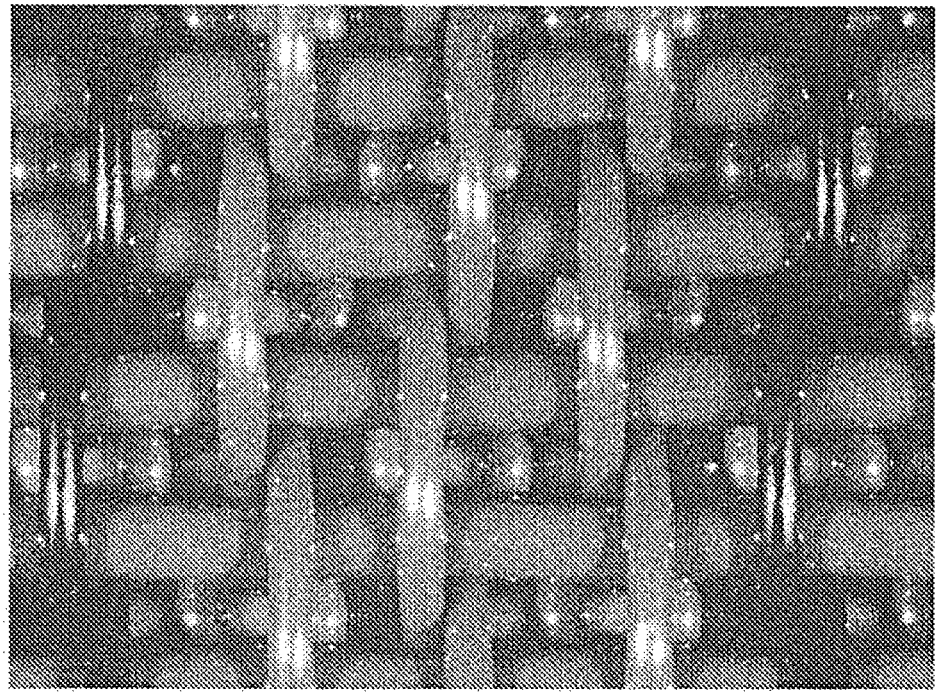
FIG. 11 is a picture showing the lower surface side of the fabric of the first embodiment.
Figure 12:
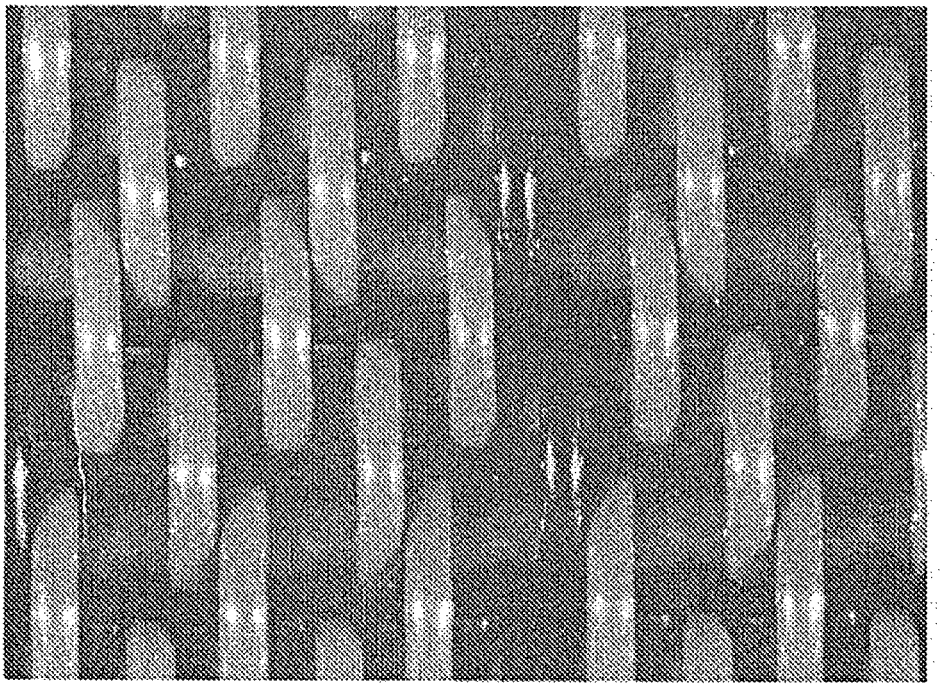
FIG. 12 is a picture showing the upper surface side of the conventional fabric.
Figure 13:
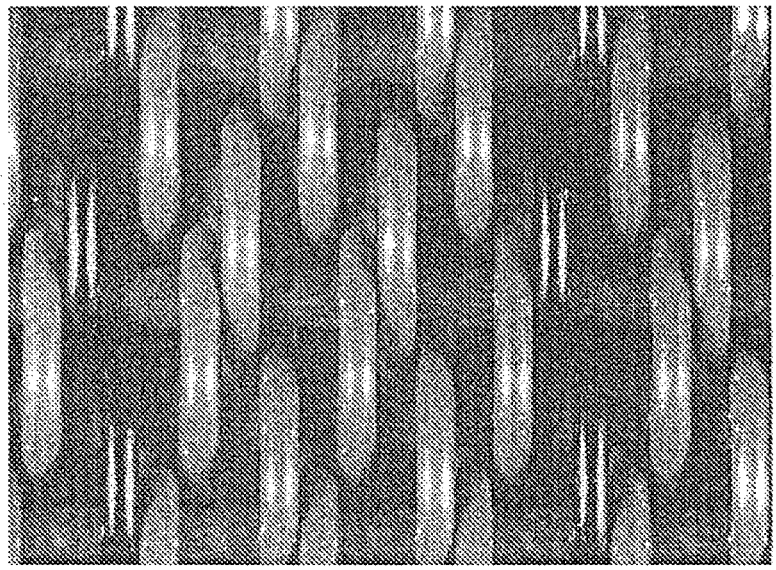
FIG. 13 is a picture showing the lower surface side of the conventional fabric.

In addition, in the conventional multi-layer fabric, the air permeability is decreased in a case where the surface density is increased. However, in the warps of the present invention, there are only the first and second warps, in other words, the lower surface side warps are not used, so that the number of the knuckles on the underside surface is less than that on the front side surface. FIG. 10 is a picture showing the front side surface of the fabric of the present invention, FIG. 11 is a picture showing the underside surface of the fabric of the present invention, FIG. 12 is a picture showing the front side surface of the conventional fabric, and FIG. 13 is a picture showing the underside surface of the conventional fabric.

The difference of the configuration of the knuckle between the present invention and the conventional fabric is clear by seeing these pictures. More specifically, the number of the knuckles in the conventional fabric is the same between FIG. 12 and FIG. 13, while, in FIG. 10 and FIG. 11, both showing the fabric of the present invention, it can be readily understood that the air permeability can be secured while at the same time the surface density is increased, since the space at the underside is more vacant than that at the front side.

These structures cause the use of the wefts with large diameters and the increase of the surface density to be compatible with each other, while causing the air permeability to be secured, irrespective of the plain weave design on the surface.

In addition, since the weft with a large diameter can be used, the lateral rigidity which is required for the fabric is secured, while at the same time, the oblique rigidity can be increased due to the pain weave design on the surface.

Accordingly, the multi-layer fabric of the present invention can improve the performance to prevent the fibers from being stuck into the wire and the sheet supportability, while at the same time maintain the lateral rigidity and the air permeability.

Alternatively, a three-layer fabric can be adopted in the present invention. The three-layer fabric can improve the rigidity, as compared with the two-layer fabric. In addition, in the conventional fabric, a single-layer fabric was adopted, and the weft was thicker than the warp and the warp passed below two wefts to form the underside knuckle, so that a structure of a warp worn type in which the warps protrude from the underside to become worn was adopted.

In the two-layer fabric of the present invention, the lower surface side weft is thicker than the warp, and the warp passes below two wefts to form the underside knuckle, so that a structure of warp worn type in which the warps protrude from the underside to become worn is also adopted.

In the three-layer fabric of the present invention, the crimp is formed on the lower surface side wefts, since the warp passes below one lower surface side weft to form the knuckle at the underside, so that the structure of weft worn type in which the lower surface side wefts protrude from the underside is adopted. Therefore, the surface to be worn of the structure of weft worn type is wider than that of the structure of warp worn type, so that the wear resistance of the former type is superior to that of the latter type. The thickness of the lower surface side wefts of the three-layer fabric may be preferably adjusted, taking account of the balance between the lower surface side wefts and the warps, since the wear in the longitudinal direction can be caused without forming the crimp if the difference of the diameter between the lower surface side wefts and the warps is too much, despite the fact that the thicker the diameter of the lower surface side wefts, the greater the wear resistance becomes.

In addition, a loop lacing can be adopted if the first and second warps of the present invention form a pair, respectively.

No particular limitation is imposed on a yarn to be used in the present invention and it can be selected freely depending on the properties which the present fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As to the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used. Generally, it is preferable to adopt monofilaments made of polyester, which exhibits a high rigidity and dimension stability, as yarns constituting the fabric.

In addition, in the present invention, a carbon line can be adopted for a portion of the first warps.

When the fabric is manufactured, it is necessary to make the wire in a state of static electrification. In such a case, the electrically born wire repels the fabric, so that it is technically difficult to form the fabric on the wire. Accordingly, the static electricity of the wire can be removed by applying the carbon line as (a portion of) the first warps. In this connection, even if the carbon line is used for the yarns except for the first warps (the upper or the lower surface side weft, for instance), such an act is still within the scope of the present invention.

No limitation is put on the diameter of the yarn constituting the fabric, however, it is preferable to adopt the upper surface side weft with a relatively small diameter and the upper surface side warp with a relatively small diameter which constitute an upper surface side layer in order to make the surface of the fabric smooth and fine. On the other hand, it is preferable to adopt the lower surface side weft with a relatively large diameter and the lower surface side warp with a relatively large diameter which constitute an lower surface side layer in order to make the lower surface of the fabric highly rigid and wearable, since the lower surface constitutes a surface contacting the machine or the roll. The diameter of the yarn may be selected taking the application, the circumstance in which the fabric is used, the ratio of the number of the upper wefts to that of the lower wefts, etc.

Now, the embodiments of the present invention will be described below with reference to the drawings. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1,2,3 . . . . The first and the second warps are indicated by the reference number to which F and S are attached, respectively.

The weft is indicated by a reference number such as 1',2',3' . . . . The upper surface side weft and the lower surface side weft are indicated by the reference number to which u and d are attached, respectively, such as 1'*u*, 2'*d*, etc. In addition, in case of the three-layer fabric, the intermediate weft disposed inside the fabric is indicated by the reference number to which m is attached.

In each of the design views, a solid square symbol "■" indicates that the first warps are disposed above the upper surface side wefts, and an open square symbol "□" indicates that the first warps are disposed below the lower surface side wefts, and a symbol x indicates that the second warps are disposed above the upper surface side wefts.

In the two-layer fabric, the upper surface side wefts and the lower surface side wefts are disposed so as not to overlap with each other, in the three-layer fabric, the upper surface side wefts, the intermediate wefts, and the lower surface side wefts are disposed so as not to overlap with each other, while the intermediate wefts and the lower surface side wefts are disposed so as to overlap with each other. The overlapping portion of the yarns in the design view is indicated by the reference number which indicates the yarn at the left side in the design view.

First Embodiment

Figure 2:
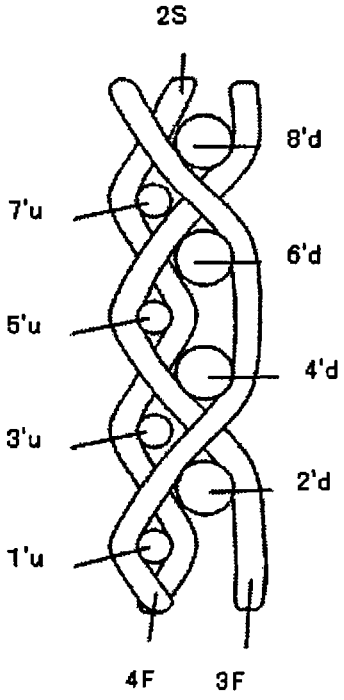
FIG. 2 is a cross-section view taken along warp 4 of the first embodiment.
Figure 3:
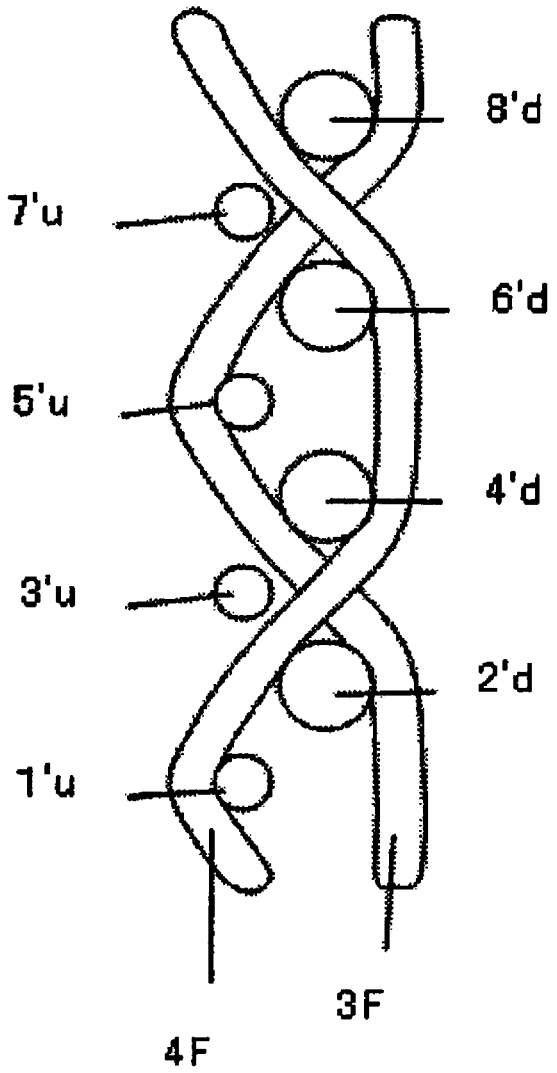
FIG. 3 is a cross-section view showing a pair of the first warps of the first embodiment.
Figure 4:
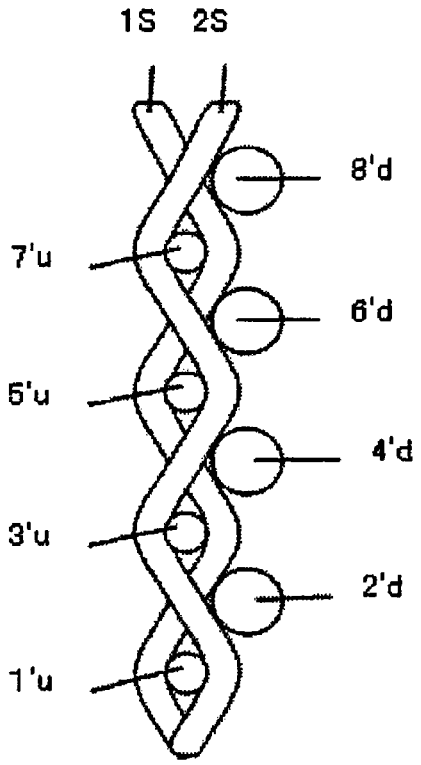
FIG. 4 is a cross-section view showing a pair of the second warps of the first embodiment.

FIG. 1 is a design view showing a complete design of the multi-layer nonwoven fabric according to the first embodiment. Each of FIGS. 2 to 4 is a cross-section view taken along the respective warps in FIG. 1. More specifically, FIG. 1 is the cross-section view taken from the warp 4F to the warp 2S, FIG. 3 is the cross-section view taken from the warp 4F to the warp 3F, and FIG. 4 is the cross-section view taken from the warp 2S to the warp 1S.

The multi-layer nonwoven fabric of the first embodiment in FIG. 1 constitute a two-layer fabric of the plain weave design on the surface including the first warp F, the second warp S, the upper surface side weft u, and the lower surface side weft d.

As shown in FIG. 1, a knuckle at an upper surface is formed by the fact the first warp 4F passes above the upper surface side weft 1'*u*, and passes above the lower surface side weft 2'*d* and below the upper surface side weft 3'*u*, and passes below the lower surface side wefts 4'*d* and 6'*d* to form a knuckle at a lower surface. Then, the first warp 4F passes below the upper surface side weft 7'*u* and above the lower surface side weft 8'*d*.

In addition, the first warp 3F cooperates with the adjacent first warp 4F to form a pair. The first warp 3F forms the knuckle at the upper surface above the upper surface side weft 5'*u*. Then, the upper surface side warp structure corresponding to a single line is formed on the surface by constituting knuckles above the upper surface side wefts 1'*u* and 5'*u*, respectively, by means of the two first warps 3F and 4F.

The second warp 1S passes above the upper surface side weft 1'*u* to form a knuckle at the upper surface, and passes below the upper surface side weft 3'*u* and above the upper surface side weft 5'*u* to forma knuckle at the upper surface, and passes below the upper surface side weft 7'*u*.

As shown in FIG. 1, in the two-layer nonwoven fabric of the first embodiment, the first and the second warps form a pair, respectively. More specifically, the second warps 1S, 2S (FIG. 4), the second warps 5S, 6S, the first warps 3F, 4F, and the first warps 7F, 8F forms a pair, respectively.

The weft of the first embodiment shown in FIG. 1 will be described below. No limitation is put on the diameter of both of the upper surface side weft and the lower surface side weft. However, the diameter of the lower surface side weft is preferably thick in order to increase the rigidity of the fabric, while the diameter of the upper surface side weft is preferably thinner than that of the lower surface side weft in order to increase the surface density. In addition, each of the upper and lower surface side wefts constitutes the off-stack structure, whereby a special density can be increased by increasing the closeness of the upper and lower surface side wefts to enhance the function to prevent the removal of the fibers.

In addition, in the two-layer nonwoven fabric of the first embodiment, it is understandable that the number of knuckles at the front side is less that at the lower surface, from the design views. FIGS. 10 and 11 are the pictures of the front side and the underside of this embodiment, respectively.

Figure 8:
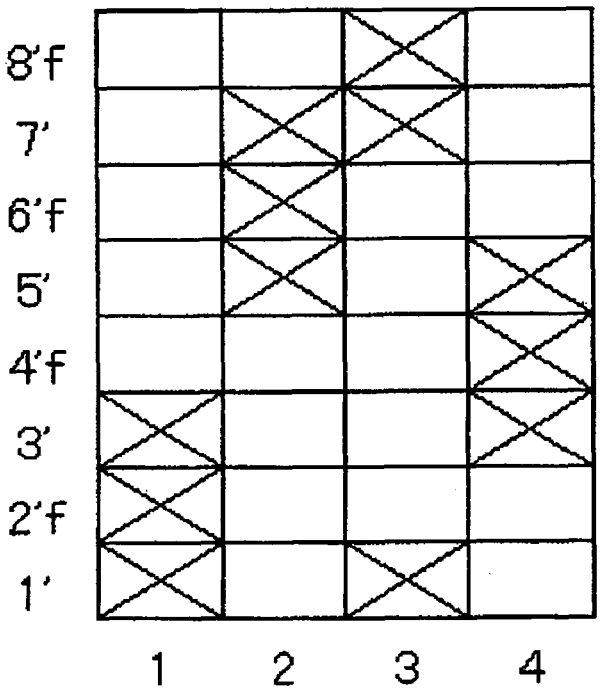
FIG. 8 is a design view showing a complete structure of the conventional fabric.
Figure 9:
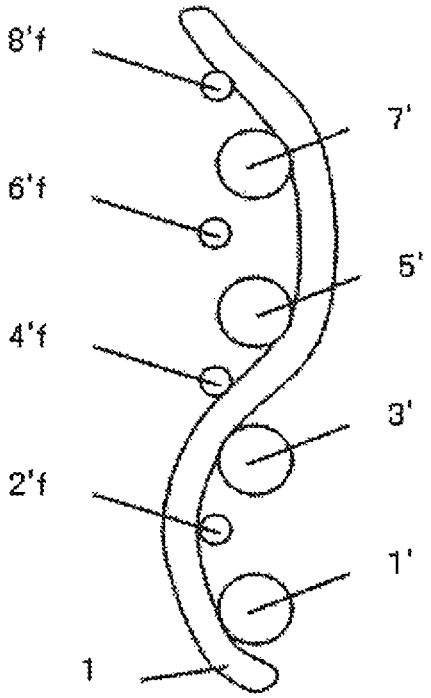
FIG. 9 is a cross-section view taken along warp 1 of the conventional fabric.

On the other hand, FIGS. 8, 12 and 13 are the design view, the front side, and the underside of a conventional fabric, respectively. As shown in FIGS. 8 and 9, the conventional fabric constitutes a single fabric using an auxiliary weft. The auxiliary weft is indicated by the reference number to which f is attached in the design view, such as 2'*f*, 4'*f*. In the fabric, as shown in the warp 1 in FIG. 8, for example, the warp 1 consecutively passes above one weft 1', one auxiliary weft 2'*f*, and one weft 3', and passes below one auxiliary weft 4'*f*, one weft 5', one auxiliary weft 6'*f*, one weft 7', and one auxiliary weft 8'*f*, while two of the adjacent wefts and four of the adjacent wefts are arranged in an alternate manner to form the complete structure.

In the conventional fabric, the number of knuckles at the front side is the same as that at the underside, so that an increase of the surface density leads to a decrease of the air permeability. However, in the two-layer fabric of the first embodiment, a space on the underside is vacant due to the fact that the number of knuckles at underside is less than that at the front side, so that a high air permeability can be secured without causing the decrease of the air permeability even if the surface density is increased.

Second Embodiment

Figure 5:
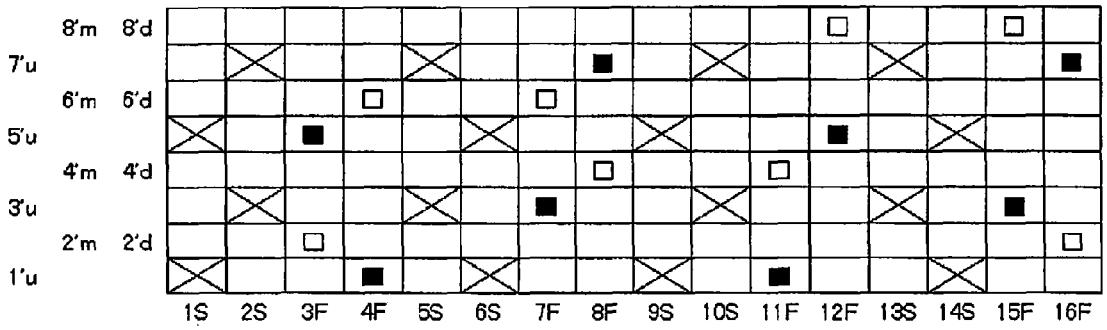
FIG. 5 is a design view showing a complete structure of the second embodiment according to the present invention.
Figure 6:
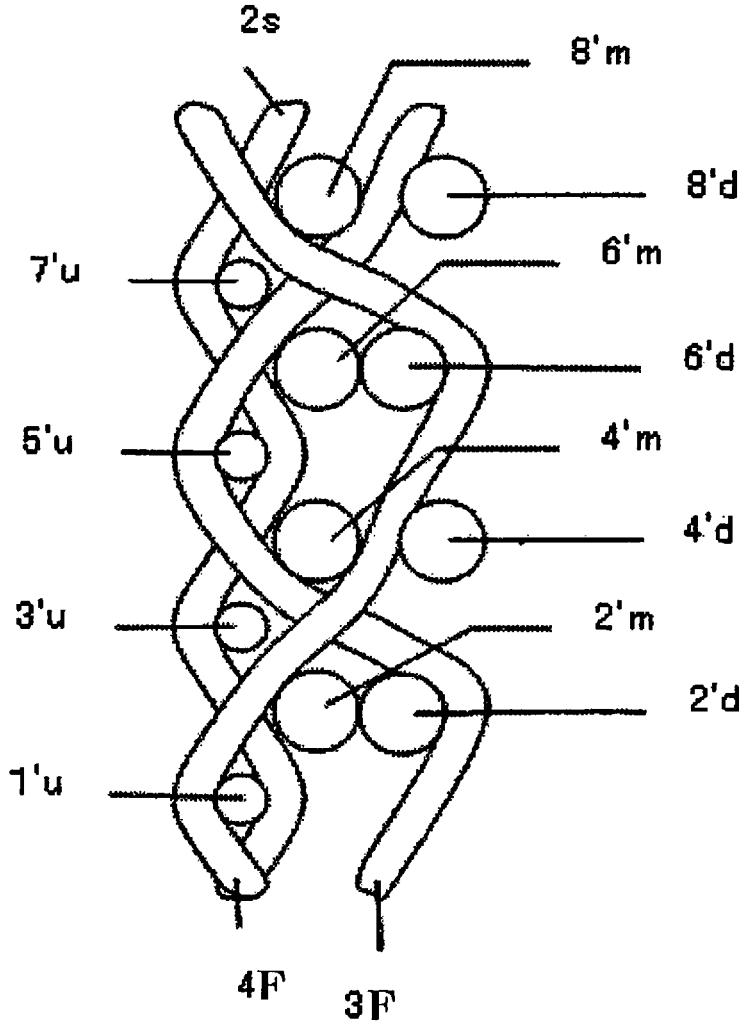
FIG. 6 is a cross-section view taken along warp 4 of the second embodiment.

FIG. 5 is a design view showing a complete design of the three-layer nonwoven fabric according to the second embodiment. FIG. 6 is a cross-section view taken from the warp 2S to the warp 4F in FIG. 5. The three-layer nonwoven fabric of the second embodiment constitutes a three-layer fabric of the plain weave design on the surface constituted by the first warp F, the second warp S, the upper surface side weft u, the intermediate weft m, and the lower surface side weft d. The intermediate weft m is added to the first embodiment.

As shown in the upper surface side warp in FIG. 5, the first warp 4F passes above the upper surface side weft 1'*u* to form the knuckle at the upper surface, and then passes above the intermediate weft 2'*m*, below the upper surface side weft 3'*u*, between the intermediate weft 4'*m* and the lower surface side weft 4'*d*, and below the lower surface side weft 6'*d* to form the knuckle at the lower surface. Then, the first warp 4F passes below the upper surface side weft 7'*u* and above the intermediate weft 8'*m*.

In addition, the first warp 3F cooperates with the adjacent first warp 4F to form a pair. The knuckle at the upper surface is formed above the upper surface side wefts 1'*u*, 5'*u* by the first warps 3F, 4F. In other words, the upper surface side warp structure corresponding to one line is formed by two lines.

In this connection, the second warp S has the almost same structure as that in the first embodiment.

Figure 14:
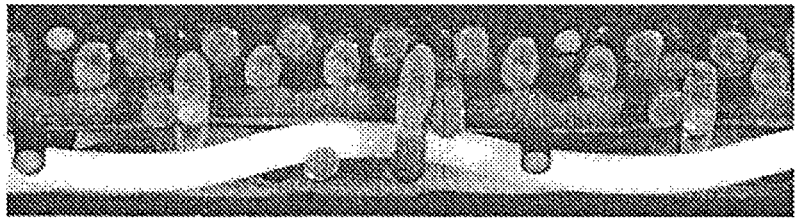
FIG. 14 is a picture showing a cross-section of the fabric of the second embodiment.
Figure 15:
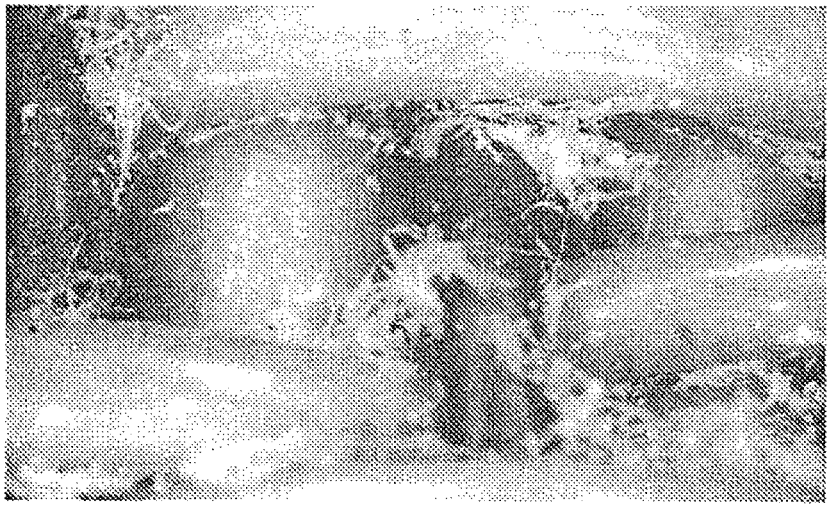
FIG. 15 is a picture showing a situation in which the convention fabric (patent publication 1) has been used.

In the three-layer unwoven fabric in the second embodiment, a long crimp is formed by the lower surface side weft d. FIG. 14 is a picture showing a cross-section of the second embodiment. As shown in FIG. 14, the long crimp of the lower surface side weft d protrudes from the underside to form a weft worn type. That is why the wear resistance is superior to the conventional warp worn type.

Third Embodiment

Figure 7:
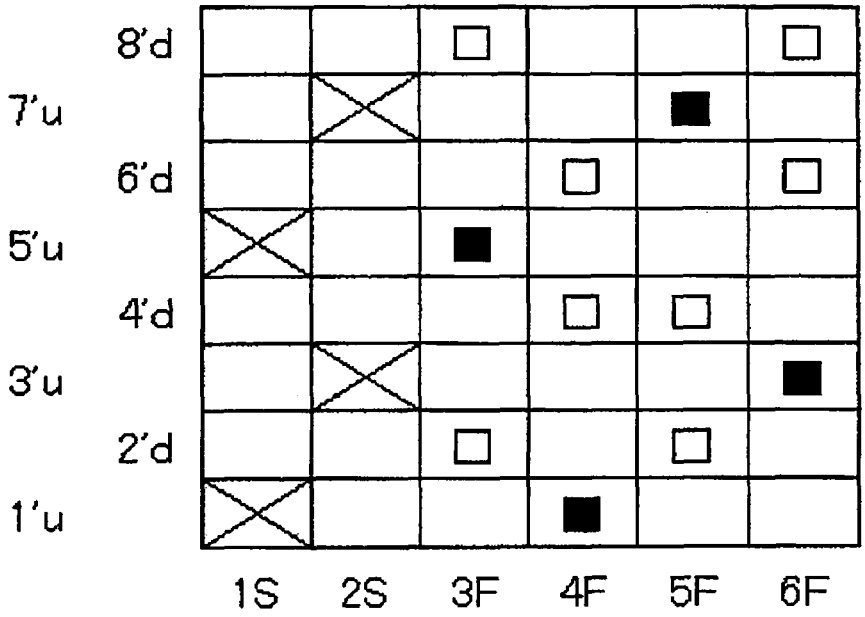
FIG. 7 is a design view showing a complete structure of the third embodiment according to the present invention.

FIG. 7 is a design view showing a complete design of the two-layer fabric according to the third embodiment. In the two-layer fabric according to the third embodiment, like the fabric in the first embodiment, the two-layer fabric of the plain weave design on the surface is constituted. However, in this embodiment, the number of first warps F and that of second warps S are two, respectively, whereas, in the first embodiment, the number of first warps F and that of second warps S are four, respectively. Except for the above, the structure of this embodiment is the same as that of the first embodiment. According to this embodiment, the air permeability can be adjusted by modifying a ratio of the number of the first warps F to that of the second warps S, and the wear resistance can be improved by increasing the number of the knuckles at the lower surface.

EXPLANATION OF SYMBOLS

3F, 4F, 5F, 6F, 7F, 8F, 11F, 12F, 15F, 16F: first weft
1S, 2S, 5S, 6S, 9S, 10S, 13S, 14S: second weft
1'*u*, 3'*u*, 5'*u*, 7'*u*: upper surface side weft
2'*d*, 4'*d*, 6'*d*, 8'*d*: lower surface side weft
2'*m*, 4'*m*, 6'*m*, 8'*m*: intermediate weft

What is claimed is:

1. In a multi-layer fabric at least constituted by a first warp, a second warp, an upper surface side weft, and a lower surface side weft, the first warp is woven with the wefts of all layers from the upper surface side weft to the lower surface side weft, the second warp is only woven with the upper surface side weft, the first warp constitutes a pair to form one upper surface side warp structure on an upper surface side layer, whereby a complete structure of a plain weave design is formed by the first and second warps.

2. The multi-layer fabric according to claim 1, wherein said first warp and said second warp are arranged to form a pair, respectively, on the upper surface side layer.

3. The multi-layer fabric according to claim 1, wherein said upper surface side weft and said lower surface side weft constitute an off-stack structure, respectively.

4. The multi-layer fabric according to claim 1, wherein a portion or all of said first warp is at least formed by a carbon line.

5. The multi-layer fabric according to claim 1, wherein said pair of said first warps and said pair of said second warps are arranged in an alternate manner.

6. The multi-layer fabric according to claim 1, wherein said multi-layer fabric constitutes a two-layer fabric.

7. The multi-layer fabric according to claim 1, wherein said multi-layer fabric further includes an intermediate weft to constitute a three-layer fabric.

* * * * *